US008083490B2

(12) United States Patent
Kitsunai et al.

(10) Patent No.: US 8,083,490 B2
(45) **Date of Patent: *Dec. 27, 2011**

(54) PROPELLER FOR WATERCRAFT, OUTBOARD MOTOR AND WATERCRAFT INCLUDING THE SAME AND THE METHOD FOR PRODUCING THE SAME

(75) Inventors: Toru Kitsunai, Shizuoka (JP); Yukihiro Kurimoto, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 1041 days.

This patent is subject to a terminal disclaimer.

(21) Appl. No.: 11/959,765

(22) Filed: Dec. 19, 2007

(65) Prior Publication Data

US 2008/0160846 A1 Jul. 3, 2008

(30) Foreign Application Priority Data

Dec. 27, 2006 (JP) ..... 2006-352833

(51) Int. Cl.
*B63H 1/26* (2006.01)

(52) U.S. Cl. ..... 416/241 R

(58) Field of Classification Search ..... 416/245 A
See application file for complete search history.

(56) References Cited

U.S. PATENT DOCUMENTS 3,744,931 A 7/1973 Cavanagh

FOREIGN PATENT DOCUMENTS

| | | | |
|---|---|---|---|
| JP | 07-034292 A | | 2/1995 |
| JP | 07-207467 A | | 8/1995 |
| JP | 3029215 U | * | 9/1996 |
| JP | 09-001319 A | | 1/1997 |

* cited by examiner

*Primary Examiner* — Richard Edgar
(74) *Attorney, Agent, or Firm* — Keating & Bennett, LLP

(57) ABSTRACT

A propeller for watercraft having excellent abrasion resistance includes a propeller body having a blade and a hub portion, the propeller body being molded from an aluminum alloy by casting, and an anodic oxide coating of the aluminum alloy provided so as to cover a surface of the propeller body. The anodic oxide coating has a thickness of about 20 μm or more in a thinnest portion and a hardness of about 330 HV or more at a near-surface level in a thickest portion.

9 Claims, 9 Drawing Sheets

PROPELLER FOR WATERCRAFT, OUTBOARD MOTOR AND WATERCRAFT INCLUDING THE SAME AND THE METHOD FOR PRODUCING THE SAME

BACKGROUND OF THE INVENTION

1. Field of the Invention

The present invention relates to a propeller for watercraft and an outboard motor.

2. Description of the Related Art

An outboard motor can be attached to a boat body by being simply engaged onto the stern of a boat, and does not occupy any space inside the boat. Therefore, outboard motors are widely used for small-sized boats, e.g., pleasure boats and small fishing boats. In accordance with the boat body sizes and purposes, outboard motors of various output powers are in use today.

Generally speaking, an outboard motor having a propeller made of stainless steel and an engine with high output power (e.g., 100 horsepower or more) is used for a relatively large boat. On the other hand, for a relatively small boat, an outboard motor having a propeller made of aluminum or the like and an engine with relatively low output power is used. An aluminum propeller is light-weight and can be produced at low cost, and therefore is suitable as a propeller of an outboard motor having an engine with low output power.

In the case of forming such a watercraft propeller from aluminum, it is necessary to prevent corrosion of the aluminum alloy caused by seawater. Therefore, generally speaking, propellers having its aluminum-alloy propeller body coated or painted with a corrosion resistance or preventative material are widely used.

Japanese Utility Model No. 3029215 discloses, in order to prevent deteriorations in water dissipation during the rotation of a propeller (which may happen when the propeller edge is made dull by any painted film that is provided on the propeller surface), subjecting an aluminum-alloy propeller to a hard anodized aluminum treatment to secure a sharp propeller edge.

Small-sized boats with outboard motors are often used at inshore locations and on rivers, for purposes such as fishery, business operations, and leisure activities, and may be pulled onto a sand beach for mooring, or may be moored in the shallow sandy area by a river shore. Therefore, when mooring a boat, or when going out onto the river or the sea from a point of mooring, sand may be stirred up, and the propeller surface is likely to be abraded as the propeller is rotated in the sand-containing water. As a result, the paint on the propeller surface peels due to such abrasion, the propeller body may be corroded, and the propeller body may be abraded. A painted coating lacks sufficient hardness, thus resulting in a problem in that the propeller of a conventional outboard motor has a short life due to abrasion.

Japanese Utility Model No. 3029215 merely discloses forming an anodized aluminum layer (which is known as a corrosion-protective coating for aluminum), instead of a painted film for corrosion protection, without teaching the aforementioned problems. Moreover, in order not to allow the propeller edge to become dull, it would be impossible to form a thick layer of hard anodized aluminum. Therefore, the thickness of the hard anodized aluminum layer for a propeller according to Japanese Utility Model No. 3029215 can only be about 15 μm, which is not considered to provide sufficient abrasion resistance and deformation resistance.

Such problems have occurred with respect not only to boats having outboard motors, but also to small-sized boats having an engine installed inside the boat.

SUMMARY OF THE INVENTION

In order to solve the aforementioned problems of conventional techniques, preferred embodiments of the present invention provide a propeller for watercraft and an outboard motor having excellent abrasion resistance.

A propeller for watercraft according to a preferred embodiment of the present invention includes: a propeller body having a blade and a hub portion, the propeller body being molded from an aluminum alloy by casting; and an anodic oxide coating of the aluminum alloy provided so as to cover a surface of the propeller body, wherein, the anodic oxide coating has a thickness of about 20 μm or more in a thinnest portion and a hardness of about 330 HV or more at a near-surface level in a thickest portion. In accordance with the propeller for watercraft of the present preferred embodiment of the present invention, the propeller body is covered by a thick anodic oxide coating having a large surface hardness, and therefore excellent abrasion resistance is achieved.

In a preferred embodiment, the film thickness of the anodic oxide coating in the thinnest portion corresponds to about 50% or more of the film thickness in the thickest portion. As a result, requirements concerning the surface hardness and the thickness of the thinnest portion can both be satisfied.

In a preferred embodiment, the anodic oxide coating has a thickness of about 100 μm or less in the thickest portion. As a result, the anodic oxide coating can maintain a high surface hardness. The producibility of the propeller can also be enhanced.

In a preferred embodiment, the hardness of the thickest portion of the anodic oxide coating at the near-surface level is no less than about 330 HV and no more than about 450 HV. As a result, the production cost can be reduced.

In a preferred embodiment, the aluminum alloy preferably is an Al—Mg alloy containing no less than about 0.3 wt % and no more than about 2.0 wt % of silicon. As a result, molding by die casting is facilitated.

In a preferred embodiment, the propeller body is molded from the aluminum alloy by die casting technique. As a result, a propeller with a high mechanical strength can be produced inexpensively.

In a preferred embodiment, the anodic oxide coating has a smaller silicon content than does the propeller body. As a result, the coating thickness uniformity is improved, and also the efficiency of coating formation is enhanced, whereby the production cost can be reduced.

An outboard motor according to another preferred embodiment of the present invention includes any of the aforementioned propellers for watercraft.

A boat according to a further preferred embodiment of the present invention includes any of the aforementioned propellers for watercraft.

A method for producing a propeller for watercraft according to yet another preferred embodiment of the present invention includes: a step (A) of molding a propeller body from an aluminum alloy by casting, the propeller body having a blade and a hub portion; step (B) of subjecting a surface of the propeller body to an electrolytic polishing or chemical polishing; and step (C) of subjecting the polished propeller body to an anodic oxidation to form an anodic oxide coating so as to cover the surface of the propeller body. As a result, a propeller for watercraft having excellent abrasion resistance can be produced and is covered with a thick anodic oxide coating having a large surface hardness.

In a preferred embodiment, between steps (A) and (B), a step (D) of subjecting the propeller body to a blast treatment is further included. As a result, the chilled layer will be removed so that a propeller for watercraft having a highly uniform exterior appearance can be produced.

According to various preferred embodiments of the present invention, the propeller body is covered by a thick anodic oxide coating having a large surface hardness, and therefore excellent abrasion resistance is achieved. Therefore, a boat having the outboard motor according to a preferred embodiment of the present invention is unlikely to undergo deformation or chipping of the propeller even when colliding against driftwood, and abrasion of the propeller is prevented even when traveling over a sandy shallow. Therefore, when used at inshore locations and on rivers, for purposes such as fishery, business operations, and leisure activities, a boat having the outboard motor according to a preferred embodiment of the present invention will exhibit excellent durability, thus being economical.

Other features, elements, processes, steps, characteristics and advantages of the present invention will become more apparent from the following detailed description of preferred embodiments of the present invention with reference to the attached drawings.

DETAILED DESCRIPTION OF PREFERRED EMBODIMENTS

In order to enhance the anti-abrasion characteristics of an aluminum-alloy propeller for watercraft, the inventors have studied the applicability of forming an anodic oxide coating on the propeller surface. An anodic oxide coating of aluminum generally has a high hardness and therefore is believed to suitably enhance anti-abrasion characteristics. However, through detailed studies it has been found that additional elements (e.g., silicon) that are contained in the aluminum alloy composing the propeller to improve the melt flow during casting make it difficult to obtain an anodic oxide coating with a uniform thickness.

Obtainment of an enhanced abrasion resistance does not immediately require an anodic oxide coating to have a uniform thickness. Rather, it suffices if the thinnest portion of the anodic oxide film has a thickness above a predetermined value. However, when anodic oxidation is performed for a long time, the surface of a portion of the anodic oxide coating that was first formed will have been immersed and electrified in the treatment liquid for a long time. As a result of this, a near-surface portion of the anodic oxide coating may be dissolved, and the surface hardness of the resultant anodic oxide coating may become so low that a sufficient hardness is hardly attained. In other words, it does not become possible to obtain a propeller having excellent abrasion resistance just by forming a thick anodic oxide coating thereon.

This also means that thicker portions of the anodic oxide film have greater thicknesses than is necessary, which leads to another problem of lowered producibility from performing anodic oxidation for a long period of time.

In order to solve these problems, the inventors have arrived at the concept of, in order to eliminate causes of variations in the film thickness of the anodic oxide coating, removing silicon particles (hereinafter occasionally referred to as "eutectic silicon particles") within those eutectic regions which exist at the surface and in the internal region down to a predetermined depth beneath the surface of the propeller body before anodic oxidation, this being done achieved through an electrolytic polishing or chemical polishing. As a result, the anodic oxide film has a uniform growth rate, whereby variations in film thickness can be reduced. Moreover, it can be ensured within a short period of time that there is a film thickness of a predetermined value or more in every portion, such that the shortened growth time helps to reduce elution at the oxide film surface. As a result, there is provided a propeller for watercraft that has a thick anodic oxide coating with a hard surface and a uniformly large thickness. Thus, the propeller for watercraft attains an improved abrasion resistance.

Hereinafter, preferred embodiments of a propeller for watercraft and an outboard motor according to the present invention will be described.

Figure 1A:
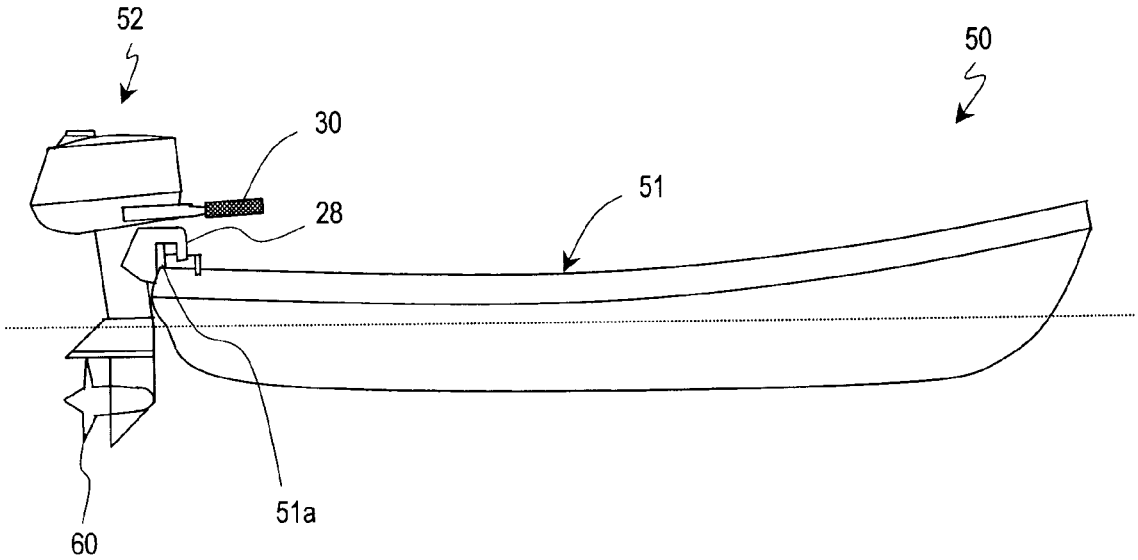
FIG. 1A is a side view of a boat having an outboard motor according to a preferred embodiment of the present invention.

FIG. 1A is a side view of a boat 50 having an outboard motor according to a preferred embodiment of the present invention. The boat 50 includes a boat body 51 and an outboard motor 52. The outboard motor 52 includes a clamp 28, a propeller 60, and a steering handle 30. The outboard motor 52 is attached at a stern 51*a* of the boat body 51 via the clamp 28. The driver is able to change the direction of travel of the boat 50 with the steering handle 30.

Figure 2:
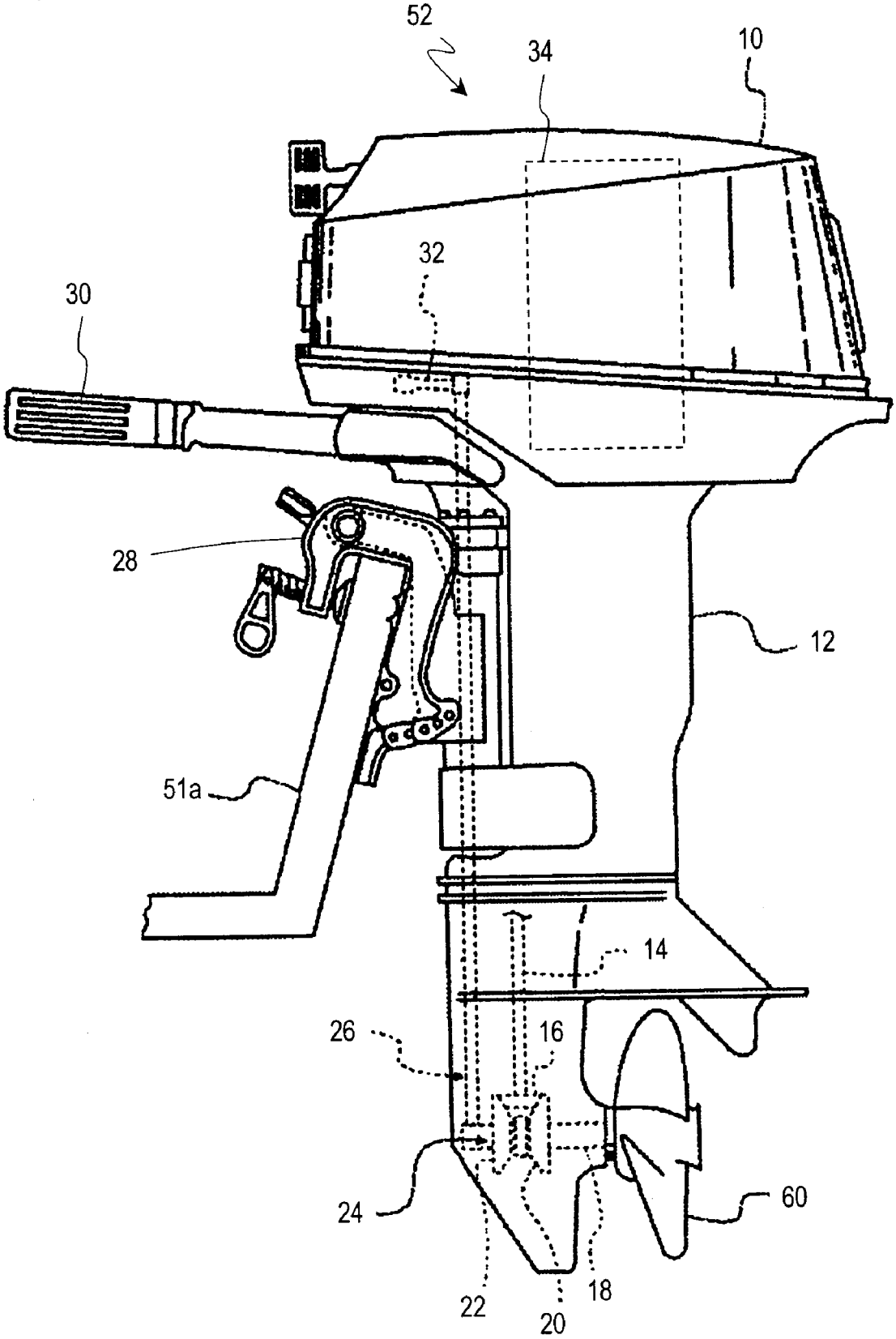
FIG. 2 is a side view showing a preferred embodiment of an outboard motor according to the present invention.

FIG. 2 is a side view of the outboard motor 52. The outboard motor 52 includes an engine 34, such that rotary motive force from the engine 34 is transmitted to a drive shaft 14, to which a driving gear 16 is attached. In order to cause the boat 50 to move forward or backward by changing the direction of rotation of the propeller 60, the outboard motor 52 includes a switching mechanism 26 and a clutch device 24. The clutch device 24 includes a forward gear 22 and a reverse gear 20. By operating a shift lever 32 which is linked to the switching mechanism 26, either the forward gear 22 or the reverse gear 20 is allowed to selectively engage with the driving gear 16. As a result, the propeller 60 which is fixed to the output shaft 18 rotates in the forward direction or reverse direction. The engine 34 and the aforementioned driving mechanism are accommodated inside a casing 12 and a cowling 10.

Figure 1B:
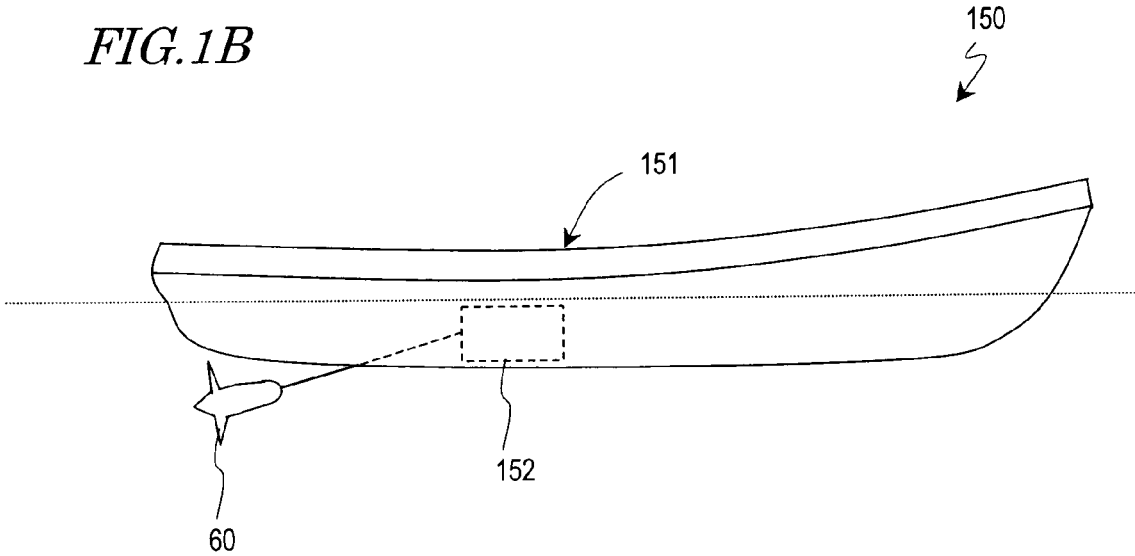
FIG. 1B is a side view showing a boat having a propeller for watercraft according to the present invention.

The propeller for watercraft according to a preferred embodiment of the present invention is suitably used for an outboard motor, but is also suitable for a boat having a so-called "inboard" engine which is mounted within the boat body. FIG. 1B is a side view of a boat 150 having a propeller 60 for watercraft according to a preferred embodiment of the present invention. Within the boat body 151 of the boat 150, an engine 152 is mounted, such that motive force from the engine 152 is transmitted via a shaft to the propeller 60 which is supported at the rear of the bottom so as to be capable of rotating.

Figure 3:
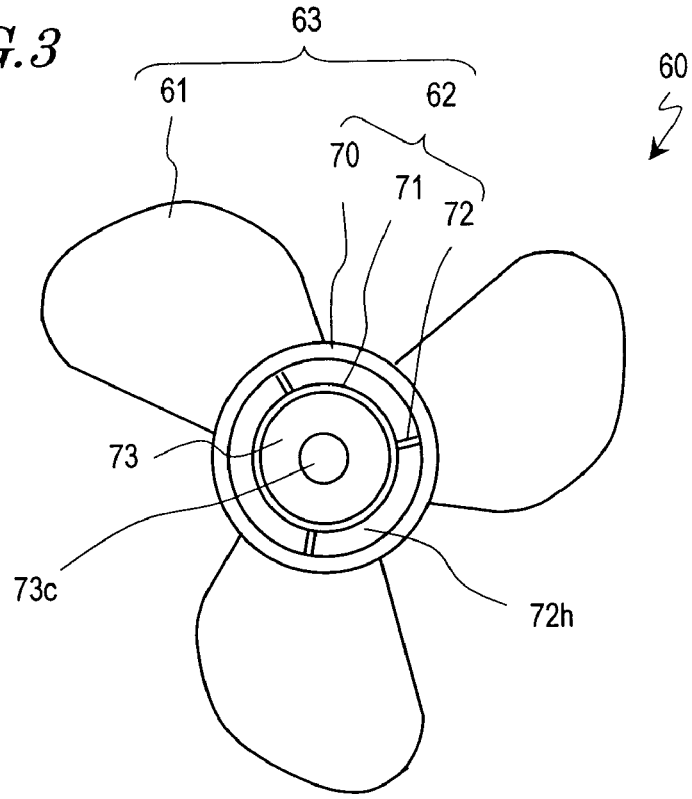
FIG. 3 is a plan view showing a preferred embodiment of a propeller for watercraft according to the present invention.

FIG. 3 is a plan view showing the propeller 60. The propeller 60 has a propeller body 63 that includes blades 61 and a hub portion 62 to which the blades 61 are connected. In the present preferred embodiment, the hub portion 62 includes an outer hub 70, an inner hub 71, and ribs 72 connecting the outer hub 70 to the inner hub 71. The present preferred embodiment adopts a structure in which the outboard motor 52 allows exhaust gas from the engine 34 to be ejected toward the rear of the propeller 60, through a gap 72*h* between the inner hub 71 and the outer hub 70, hence arriving at the double-structured hub portion. The hub portion 62 may have a single structure in the case where the outboard motor 52 allows exhaust gas to be released at another location. There is no limitation as to the number of blades 61 and their shape. The propeller 60 may have any other shape than that illustrated in FIG. 3.

The inner hub 71 of the hub portion 62 defines a cylindrical internal space, with a bushing 73 being press-fitted into the internal space. The bushing 73 is preferably composed of an elastic body such as rubber, such that the bushing 73 is fixed within the inner hub 71 based on friction between the bushing 73 and the inner hub 71. A hole 73*c* is provided in the center of the bushing 73, and the output shaft 18 is inserted into the hole 73*c*.

Since the bushing 73 and the inner hub 71 are fixed based on friction, when the propeller 60 collides into driftwood or the like during its rotation, the bushing 73 will slip within the inner hub 71, so that the propeller 60 can come to a stop while allowing the output shaft 18 to rotate. Thus, the gears are prevented from being destroyed and malfunctioning of the engine 34 is prevented.

The propeller body 63 is integrally molded from an aluminum alloy by casting, as has been described earlier. Therefore, the propeller body is preferably composed of an aluminum alloy whose composition is suitable for casting. In order to ensure that the melt of the aluminum alloy has a sufficient flowability, the aluminum alloy preferably contains silicon, and more preferably contains no less than about 0.3 wt % and no more than about 2.0 wt % of silicon. If the silicon content were smaller than about 0.3 wt %, the melt would not have sufficient flowability, thus resulting in poor castability. By ensuring that the silicon content is about 2.0 wt % or less, eutectic silicon particles in the region of the aluminum alloy which will become the anodic oxide coating can be sufficiently removed by electrolytic polishing or chemical polishing, so that an anodic oxide coating can be obtained whose film thickness is even more uniform.

Molding of the propeller body 63 is preferably performed by die casting technique. After the melt is injected into a mold by using die casting technique, the melt is rapidly cooled, whereby the eutectic regions can be made smaller. This can also reduce the particle sizes of the eutectic silicon particles.

More preferably, the aluminum alloy further contains no less than about 0.5 wt % and no more than about 1.8 wt % of at least one of iron and manganese. When at least one of iron and manganese is contained at the aforementioned rate, it is possible to obtain an improved releasability from the mold in die casting molding, thus preventing burning onto the mold. Furthermore, by containing magnesium in an amount of no less than about 2.5 wt % and no more than about 5.5 wt %, the aluminum alloy can have improved mechanical properties (e.g., mechanical strength, elongation, and shock resistance) as well as improved anti-corrosiveness.

As the aluminum alloy, for example, an Al—Mg alloy having a composition such as Al-4Mg-0.8Fe-0.4Mn, Al-5Mg-1.3Si-0.8Fe-0.8Mn, Al-6.5Mg-1.1Fe-0.7Mn, or Al-5Si-0.4Mg can be used.

Figure 4:
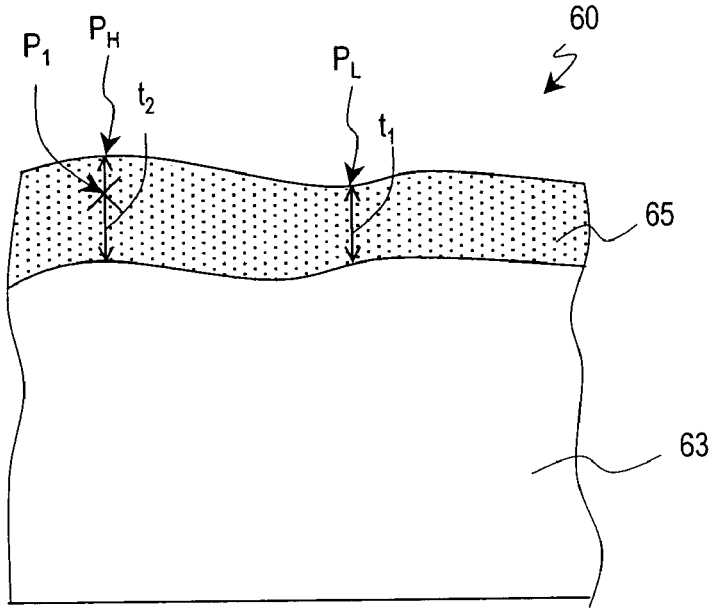
FIG. 4 is a schematic view showing a cross section of the propeller for watercraft of FIG. 3.

FIG. 4 schematically shows a cross section of the propeller 60. As shown in FIG. 4, the propeller 60 has an anodic oxide coating 65 which is provided on the surface of the propeller body 63 so as to cover the propeller body 63. The anodic oxide coating 65 is obtained by subjecting the surface of the propeller body 63 to an electrolytic polishing or chemical polishing and thereafter performing an anodic oxidation.

In its thickest portion $P_H$, the anodic oxide coating 65 preferably has a hardness of about 330 HV or more at a near-surface level $P_1$. Thus, the propeller 60 with the anodic oxide coating 65 formed thereon has a high abrasion resistance. As used herein, the "near-surface level" refers to a depth of about 10 μm from the surface, as will be described in connection with the Examples below. If the hardness at the near-surface level $P_1$ of the anodic oxide coating 65 in the thickest portion $P_H$ is smaller than about 330 HV, adequate anti-abrasion characteristics cannot be obtained. From the standpoint of abrasion resistance, the hardness of the anodic oxide coating should be as high as possible. However, in order to obtain an anodic oxide coating with a hardness greater than about 450 Hv, it will become necessary to use special treatment liquids, thus resulting in an increased production cost of the anodic oxide coating. Therefore, it is preferable that the hardness at the near-surface level $P_1$ in the thickest portion $P_H$ is no less than about 330 HV and no more than about 450 HV.

Moreover, in its thinnest portion $P_L$, the anodic oxide coating 65 preferably has a thickness t1 of about 20 μm or more. As used herein, "thickness" refers to a thickness as ascertained by "coating thickness measurement by microscope" defined under JIS H8680. If the thickness of the anodic oxide coating 65 in its thinnest portion $P_L$ is smaller than about 20 μm, adequate anti-abrasion characteristics will not be obtained, and, through abrasion, the propeller body 63 is likely to be exposed in the thin portions of the anodic oxide coating 65. In the thickest portion $P_H$, the anodic oxide coating 65 preferably has a thickness of about 100 μm or less. If the thickness of the thickest portions $P_H$ exceeds about 100 μm, the surface of the resultant anodic oxide film will become brittle through a long time of anodic oxidation, and the hardness of the near-surface level $P_1$ will become smaller than about 330 HV. Moreover, it will take time to form such a thick anodic oxide coating 65, and thus the producibility will be deteriorated.

As described earlier, from the standpoint of propeller abrasion resistance, requirements for a propeller to have excellent abrasion resistance are that the surface hardness and the thickness of the thinnest portion of the anodic oxide coating satisfy the aforementioned ranges. That is, uniformity in the film thickness of the anodic oxide coating does not directly affect abrasion resistance. However, by forming an anodic oxide film with a uniform thickness, the aforementioned requirements concerning the surface hardness and the thickness of the thinnest portion of the anodic oxide coating can both be satisfied. For this reason, it is preferable that the anodic oxide coating 65 has a uniform film thickness, and it is more preferable that a film thickness $t_1$ of the thinnest portion $P_L$ of the anodic oxide coating 65 corresponds to about 50% or more of a film thickness $t_2$ of the thickest portion $P_H$.

The hardness of the anodic oxide coating 65 can be adjusted by changing the concentration and temperature of an electrolytic bath which is used for the anodic oxidation. The thickness of the anodic oxide coating 65 can be adjusted based on the length of time of anodic oxidation. As a method of anodic oxidation treatment for forming the anodic oxide coating 65, it is preferable to use a treatment method which allows a hard anodic oxide coating to be formed, and an electrolyte such as sulfuric acid or oxalic acid can be used.

Figure 5:
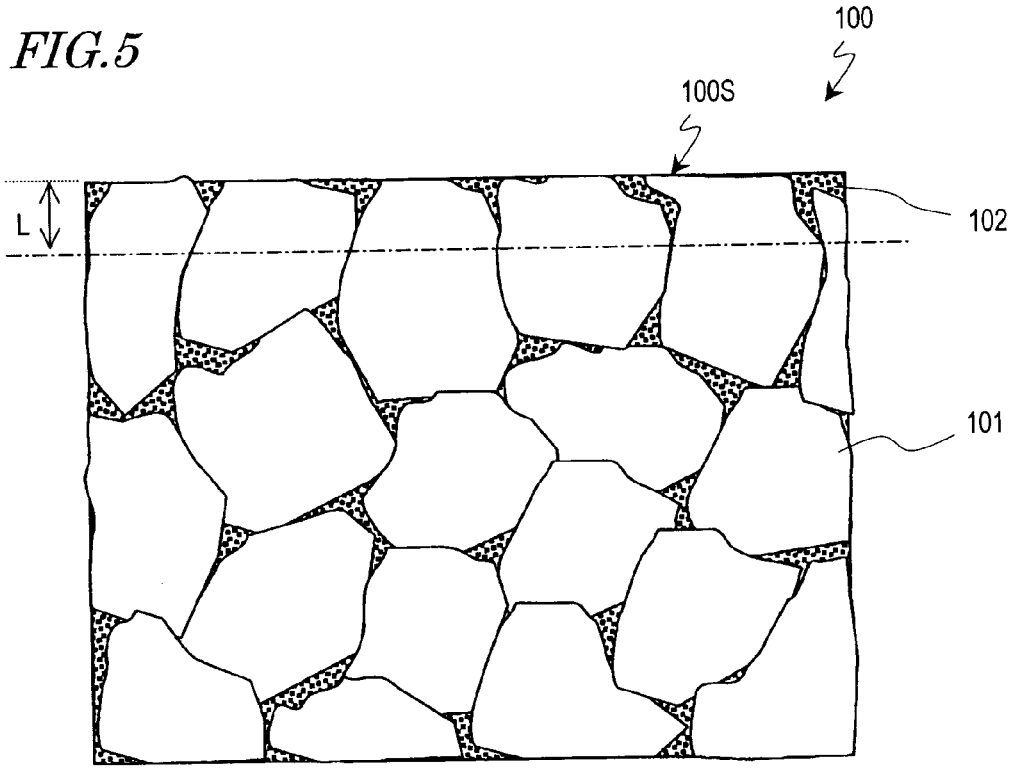
FIG. 5 is a cross-sectional view schematically showing the metallurgical structure of the propeller body of the propeller for watercraft of FIG. 3 before being subjected to anodic oxidation.

Next, a method for forming the anodic oxide coating 65 will be specifically described. FIG. 5 schematically shows a cross-sectional structure of a propeller body 100 which has been molded by a die casting technique. When an aluminum alloy is molded by the die casting technique, within the melted aluminum alloy, aluminum first deposits as primary-crystal aluminum 101. Thereafter, to bury the gaps between a multitude of regions of deposited primary-crystal aluminum 101, eutectic regions 102 of aluminum are deposited, which contain a crystallized silicon and compounds of magnesium, manganese, and the like. Since the eutectic regions 102 contain crystallized silicon and compounds of magnesium, manganese, and the like, the eutectic regions 102 exhibit a different reaction rate in anodic oxidation from that of the primary-crystal aluminum 101, in which hardly any other elements are contained. As a result, the anodic oxide film may vary in film thickness.

Figure 6:
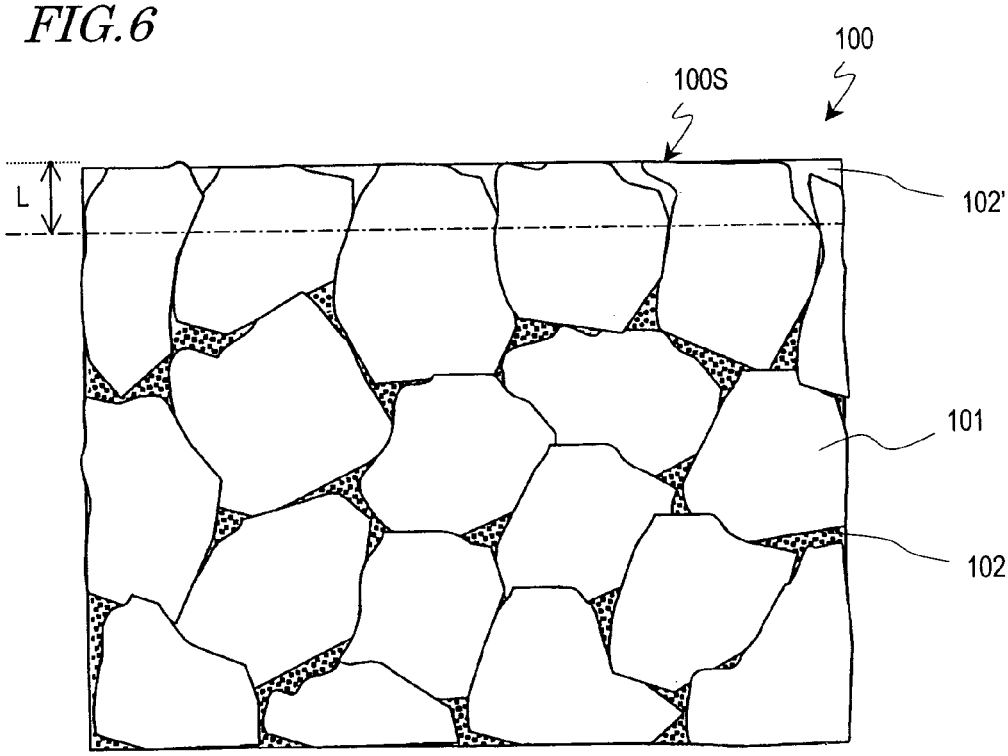
FIG. 6 is a cross-sectional view showing the metallurgical structure after the propeller body of FIG. 5 is subjected to chemical polishing.

In a preferred embodiment of the present invention, before forming an anodic oxide film, crystallized substances and compounds in the eutectic regions 102 (especially silicon particles) are removed from a region to become an anodic oxide film which extends from the surface 100S of the propeller body 100 down to a depth L. In order to selectively remove the crystallized substances and compounds in the eutectic regions 102, electrolytic polishing or chemical polishing is used. As a result, as shown in FIG. 6, in the region down to the depth L from the surface 100S of the propeller body 100, the crystallized substances and compounds in the eutectic regions 102 are removed, thus only leaving the primary-crystal aluminum 101 and the eutectic regions 102' which are free of crystallized substances and compounds. Since electrolytic polishing or chemical polishing is used, the polishing solution intrudes relatively deep inside from the surface 100S of the propeller body 100, so that the crystallized substances and compounds in the eutectic regions 102 can be selectively removed. By using a chemical reaction, unlike by mechanical grinding such as shotblasting, a difference in chemical reactivity between the crystallized substances and compounds in the eutectic regions 102 and all the other portions is utilized, so that the crystallized substances and compounds in the eutectic regions 102 are removed with a higher priority.

Instead of removing the crystallized substances and compounds (e.g., silicon particles) from within the eutectic regions 102 through selectively elution, the eutectic regions 102 surrounding the crystallized substances and compounds may themselves be eluted, thus allowing the crystallized substances and compounds to be removed from the region to become the anodic oxide coating which extends from the surface 100S of the propeller body 100 down to the depth L. In this case, the crystallized substances and compounds may also be eluted at the same time. When the eutectic regions 102 surrounding the crystallized substances are eluted, the eutectic regions 102 are eliminated from the region extending down to the depth L from the surface 100S of the propeller body 100.

The conditions for a chemical polishing for removing the crystallized substances and compounds (e.g., silicon particles) in the eutectic regions 102 may be as follows, for example.

Condition 1

Polishing Solution: an aqueous solution containing 15% nitric acid and 10% hydrofluoric acid Processing Time: 60 seconds Processing Temperature: room temperature Condition 2

(1) Treatment 1

Polishing Solution: an aqueous solution containing 5% nitric acid and 60% phosphoric acid Processing Time: 120 seconds Processing Temperature: 95° C.

(2) Treatment 2 (to be Performed After Treatment 1)

Polishing Solution: an aqueous solution containing 15% nitric acid and 10% hydrofluoric acid Processing Time: 15 seconds Processing Temperature: room temperature The conditions for an electrolytic polishing for removing the crystallized substances and compounds (e.g., silicon particles) in the eutectic regions 102 may be as follows, for example.

Condition 3

(1) Treatment 1

Treatment Liquid: 50% sulfuric acid aqueous solution

Current Density: 30 A/dm$^2$

Processing Time: 120 seconds

Processing Temperature: 50° C.

(2) Treatment 2 (to be Performed After Treatment 1)

Polishing Solution: an aqueous solution containing 15% and nitric acid and 10% hydrofluoric acid Processing Time: 15 seconds Processing Temperature: room temperature Thus, an anodic oxide coating is formed by performing an anodic oxidation on the surface of a propeller body such that the crystallized substances and compounds from its eutectic regions in a near-surface level region have been eliminated.

Figure 7A:
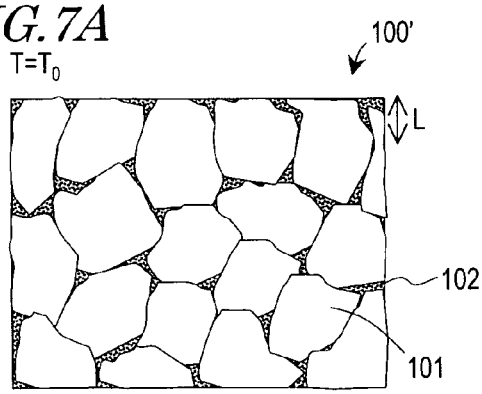
FIGS. 7A to 7G are schematic diagrams illustrating anodic oxide coatings growing on the propeller body shown in FIG. 6 and on a propeller body which has not been subjected to chemical polishing.
Figure 7E:
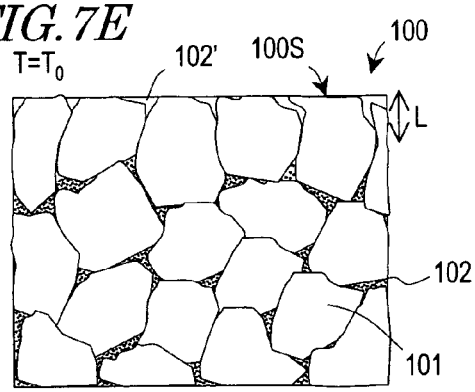
Figure 7B:
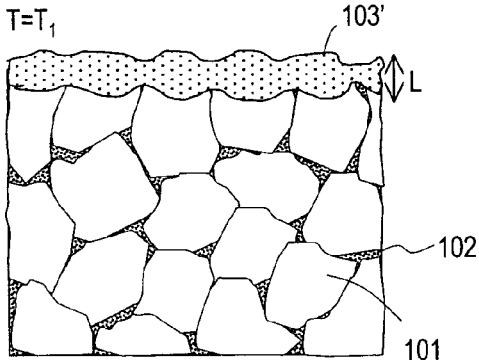
Figure 7F:
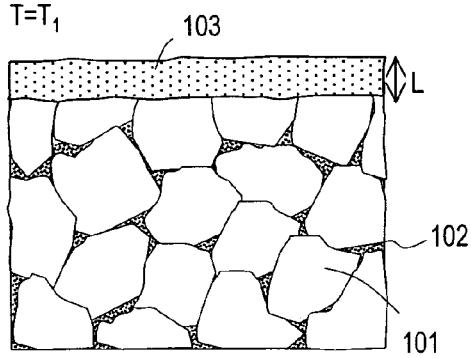
Figure 7C:
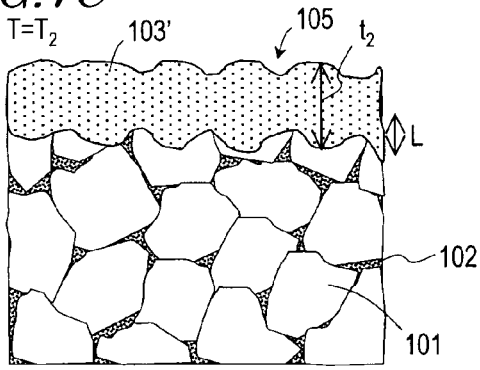
Figure 7G:
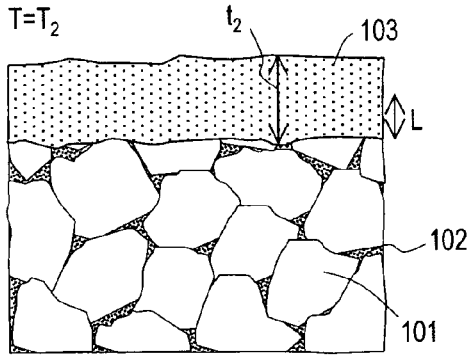

FIGS. 7A to 7G are schematic diagrams illustrating growth of an anodic oxide coating via anodic oxidation, the illustrations being presented through a comparison between the case where the crystallized substances and compounds in the eutectic regions are removed and the case where they are not removed. Each of FIGS. 7E to 7G shows a cross section of a propeller body such that the crystallized substances and compounds in its eutectic regions have been removed in a near-surface level region. Each of FIGS. 7A to 7D shows a cross section of a propeller body such that the crystallized substances and compounds in its eutectic regions have not been removed.

As shown in FIG. 7E, at $T=T_0$, when anodic oxidation begins, crystallized substances and compounds in the eutectic regions 102' have been removed within the depth L from the surface of the propeller body 100. On the other hand, in a propeller body 100' shown in FIG. 7A, the crystallized substances and compounds in the eutectic regions have not been removed, but exist in the eutectic regions in the region within the depth L from the surface.

After the start of anodic oxidation, an anodic oxide coating begins to grow from the surface of the propeller body 100. Any interface between the generated anodic oxide coating and the propeller body 100 always serves as an interface from which more anodic oxide coating will occur. Since only primary-crystal aluminum exists at the surface of the propeller body 100, an anodic oxide coating grows at a uniform growth rate across the entire region with the exposed surface. As shown in FIG. 7F, at $T=T_1$, an anodic oxide coating 103 has grown to a uniform thickness. Since the crystallized substances and compounds in the eutectic regions have been removed, the silicon content in the anodic oxide coating 103 is smaller than in the case of the propeller body 100.

On the other hand, as shown in FIG. 7B, in the propeller body 100' in which the crystallized substances and compounds in the eutectic regions are not removed, the growth rate of anodic oxide coating is slowed in the eutectic regions, and therefore the anodic oxide coating 103' having grown at $T=T_1$ has a non-uniform film thickness.

As shown in FIG. 7G, at $T=T_2$, the anodic oxide coating 103 generated on the propeller body 100 has a uniform thickness $t_2$ almost across its entirety. Given that the anodic oxide coating 103 needs to have the thickness of $t_2$ or more in order to ensure good anti-abrasion characteristics, it can be said that any portion of the anodic oxide coating 103 has sufficient anti-abrasion characteristics at this point, since the film thickness is essentially uniform.

On the other hand, as shown in FIG. 7C, the anodic oxide coating 103' of the propeller 100' has a non-uniform film thickness because the film growth rate is slowed in portions where the crystallized substances and compounds of the eutectic regions 102 exist. At $T=T_2$, the thickness has reached $t_2$ in portions where the crystallized substances and compounds of the eutectic regions 102 do not exist, as is the case with the anodic oxide coating 103 of the propeller body 100 shown in FIG. 7G. However, in a portion 105 having the crystallized substances and compounds of the eutectic regions 102, the anodic oxide coating 103' has a slower growth, thus resulting in a smaller film thickness. In other words, at this point, the anodic oxide coating 103' has not acquired the desired anti-abrasion characteristics yet.

Figure 7D:
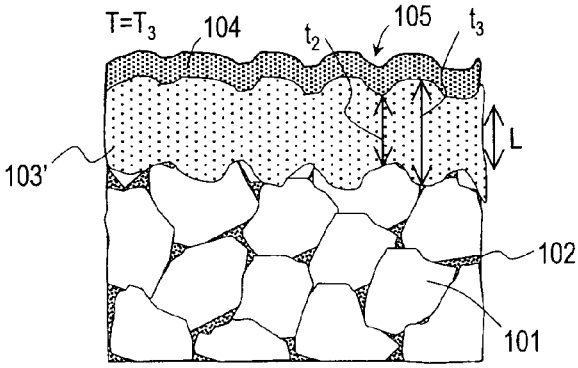

In the propeller body 100', in order for the film thickness of the anodic oxide coating 103' at the thinnest portion 105 to reach $t_2$, anodic oxidation must be continued further. As shown in FIG. 7D, at $T=T_3$, the film thickness in the thinnest portion reaches t2. At this time, the film thickness of the thickest portion is $t_3$ ($>t_2$).

It might seem that the anodic oxide coating 103' formed on the propeller 100' has now acquired the predetermined abrasion resistance. However, since a longer time is required for anodic oxidation than in the case of the propeller 100 ($T_3>T_2$), the near-surface level region of the anodic oxide coating 103' has been immersed in the anodic oxidation solution for a longer time, thus allowing the oxide film to be eluted and causing a lower surface hardness. Consequently, as shown in FIG. 7D, the near-surface portion 104 of the anodic oxide coating 103' has a smaller hardness than that of the anodic oxide coating 103 of the propeller 100 at $T=T_2$, and inferior anti-abrasion characteristics compared to those of the anodic oxide coating 103.

Thus, unless the portion of the propeller body to become an anodic oxide coating has a uniform composition, the resultant anodic oxide coating will have a non-uniform film thickness, and the anodic oxide coating will have a deteriorated surface hardness because of having been immersed in the anodic oxidation solution for a long time.

In contrast, according to a preferred embodiment of the present invention, the portion of the propeller body to become an anodic oxide coating has a uniform composition, and therefore the resultant anodic oxide coating will have a uniform film thickness and excellent anti-abrasion characteristics.

Figure 8:
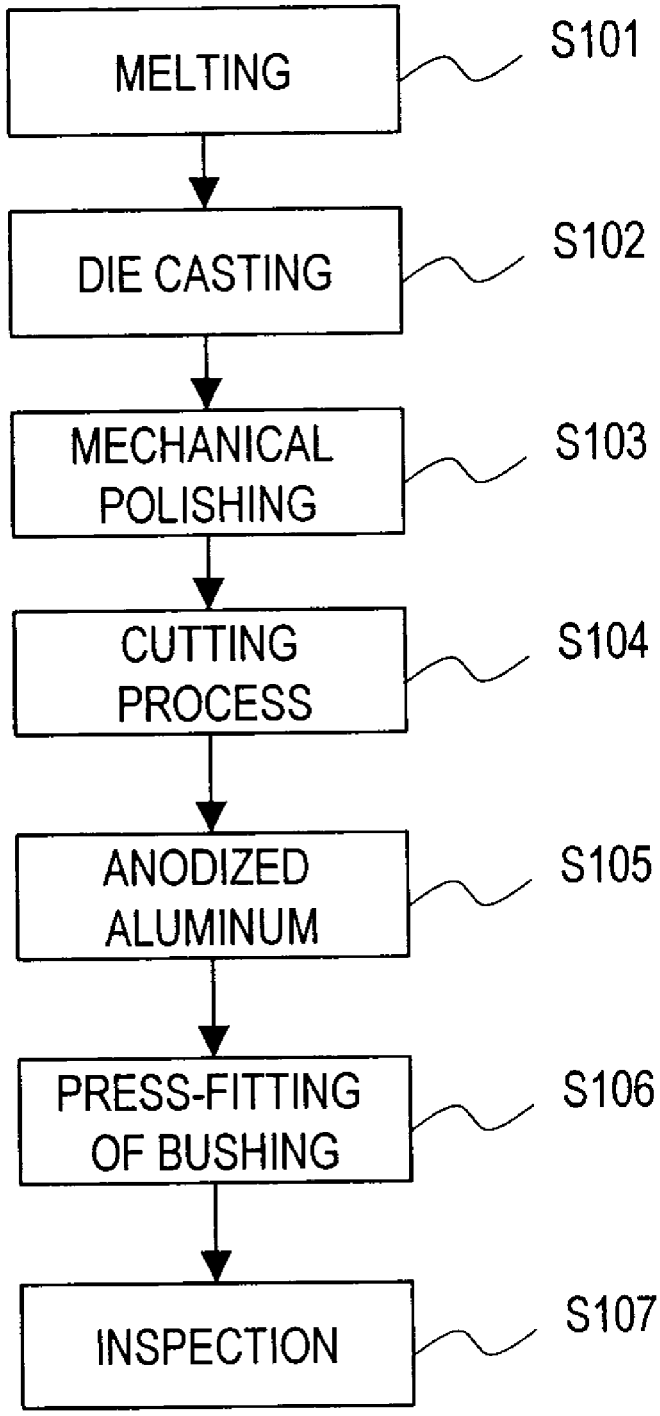
FIG. 8 is a flowchart showing production steps for a propeller for watercraft.

A propeller according to a preferred embodiment of the present invention can be produced by the following procedure, for example. As shown in FIG. 8, an aluminum alloy having a composition of Al-4Mg-0.8Fe-0.4Mn, for example, is melted (step S101), and the melt is injected into a mold of the shape shown in FIG. 3 according to die casting technique (step S102). After cooling, the gate for melt injection is cut off from the propeller body which has been taken out of the mold.

Next, the surface of the propeller body is mechanically polished by shotblasting or the like (step S103). This mechanical polishing is particularly effective in the case where a chilled layer is formed on the surface of the propeller body such that the chilled layer has a different color tone and exterior appearance from the other portions after the formation of the anodic oxide coating. As a result, foreign matter and the like on the surface of the propeller body can be removed, and an anodic oxide coating that has a uniform exterior appearance can be formed. Thereafter, any draft (in connection with casting) that has occurred in the interior space of the inner hub 71 is removed, and a cutting is performed so that the inner hub 71 takes a predetermined shape (step S104).

Figure 9:
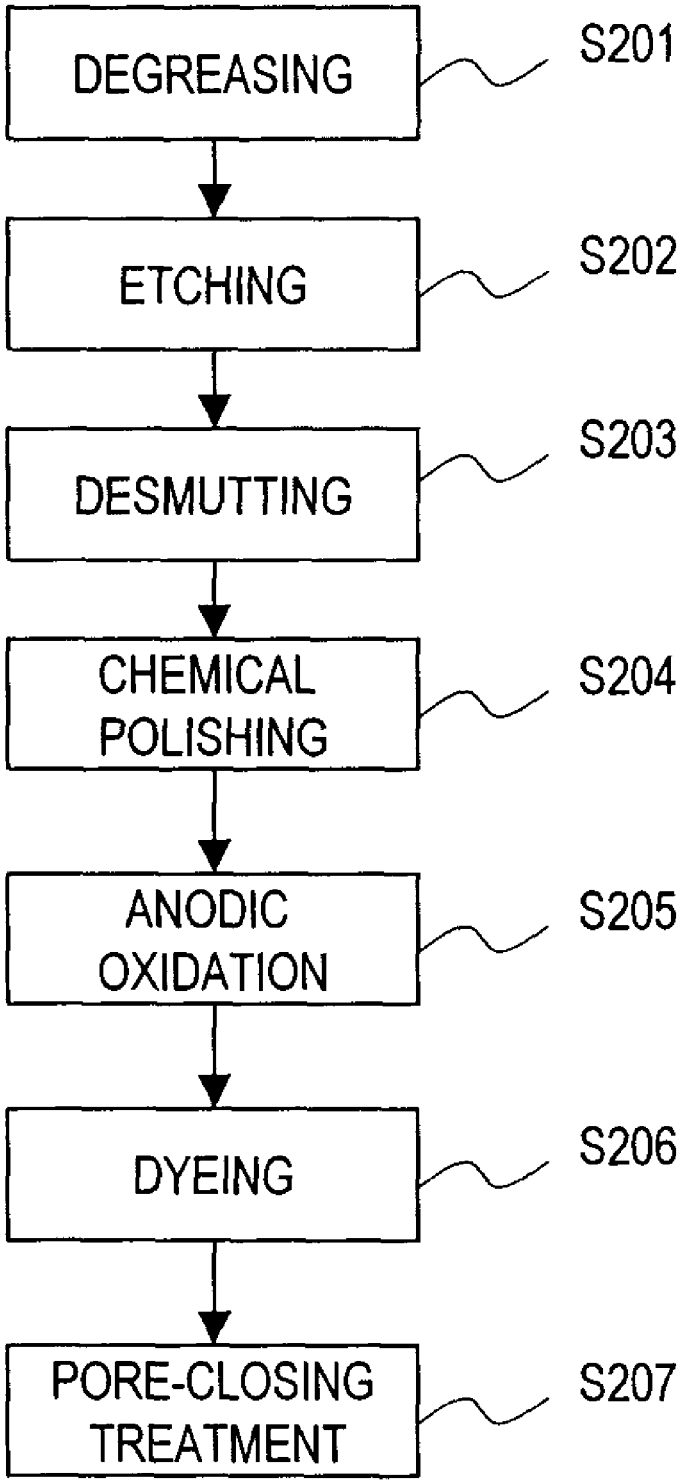
FIG. 9 is a flowchart specifically describing the anodic oxidation treatment step of FIG. 8.

Next, an anodized aluminum treatment for forming an anodic oxide coating is performed (step S105). As shown in FIG. 9, first, degreasing and etching for the propeller body surface is performed (steps S201, S202) to clean the propeller surface. As necessary, a desmutting treatment may also be performed (step S203).

Next, electrolytic polishing or chemical polishing is performed (step S204). Exemplary conditions for electrolytic polishing or chemical polishing have been set forth above.

Thereafter, an anodic oxidation is performed (step S205). For example, by using an approximately 17% sulfuric acid bath and using the propeller body as an anode, an oxidation is performed for 30 minutes with a constant current of about 4 $A/dm^2$, while maintaining a bath temperature of about 4° C. As a result, an anodic oxide coating having a thickness of about 40 μm and a hardness of about 400 Hv is obtained. Next, dyeing may be performed as necessary (step S206). The dyeing can be performed through coloration by dyestuff, electric field coloration, or the like, which takes place by allowing a dyestuff or metal oxide to deposit within the micropores in the anodic oxide coating. Thereafter, a pore-closing treatment is performed for the micropores in order to prevent decolorization and insufficiencies in anti-corrosiveness (step S207).

Thereafter, as shown in FIG. 8, a bushing is press-fitted into the hub of the propeller (step S106), and a completion inspection (S107) is performed, whereby the propeller is completed.

The propeller 60 having the above structure is covered by an anodic oxide coating which has a hardness of about 330 HV or more at the near-surface level and the film thickness in whose thinnest portion is about 20 μm or more, and therefore has an excellent abrasion resistance. An anodic oxide coating which has such a large surface hardness and is thick is obtained from an underlayer of a uniform composition, and the anodic oxide coating has a highly uniform film thickness. Therefore, problems such as corrosion caused by exposure of the aluminum alloy caused by the progress of local abrasion are unlikely to occur, and thus the propeller can enjoy a long product life. In particular, abrasion of the propeller surface can be prevented even in water which is mixed with sand or the like. Thus, there also are economical advantages. Furthermore, in terms of the exterior appearance of the propeller, color mottling or the like is unlikely to occur because the anodic oxide coating has a uniform thickness. Thus, a propeller which is also aesthetically excellent is obtained.

Therefore, a boat having the outboard motor according to a preferred embodiment of the present invention is unlikely to undergo deformation or chipping of the propeller even when colliding against driftwood, and abrasion of the propeller is prevented even when traveling over a sandy shallow. Therefore, when used at inshore locations and on rivers, for purposes such as fishery, business operations, and leisure activities, a boat having the outboard motor according to a preferred embodiment of the present invention will exhibit excellent durability, thus being economical.

EXPERIMENTAL EXAMPLES

In order to confirm the effects of preferred embodiments of the present invention, using an aluminum alloy having a composition of Al-4Mg-0.8Fe-0.4Mn-0.3Si, propeller bodies were molded by die casting technique, and subjected to treatments according to the steps illustrated in FIGS. 8 and 9, whereby propellers of Examples 1 to 3 were obtained. Note that the treatment time of anodic oxidation was varied between Examples 1 to 3. Moreover, by using an aluminum alloy having a composition of Al-5Si-0.4Mg, a propeller of Example 4 was similarly obtained.

As a comparative example, by using an aluminum alloy having a composition of Al-5Si-0.4Mg, a propeller body was molded by die casting technique, and subjected to treatments according to the steps illustrated in FIGS. 8 and 9, whereby a propeller of Comparative Example 2 was obtained. Moreover, a propeller of Comparative Example 1 was obtained through similar steps to the Examples, except that the chemical polishing treatment was omitted. Furthermore, by using an aluminum alloy having a composition of Al-4Mg-0.8Fe-0.4Mn-0.3Si, a propeller of Comparative Example 3 was obtained through similar steps to the Examples, except that the chemical polishing treatment was omitted. The characteristics of the Samples produced were evaluated as follows.

Thickness

For each sample, the thickness of the anodic oxide coating was measured in its thickest portion and thinnest portion. Thickness was ascertained by "coating thickness measurement by microscope" as defined under JIS H8680.

Hardness

The hardness across a cross section of the anodic oxide coating was measured. The hardness measurement was taken according to JIS Z 2244. The applied load was 0.025 (i.e., a pad was pressed with a force of 25 g), and the measurements were taken at a near-surface level and near-material (i.e., propeller body) level in the thickest portion of each coating. The "near-surface level" refers to a depth of about 10 μm from the surface of the anodic oxide coating, and the measurement was taken so that the pad center coincided with this position. The "near-material level" refers to a position shifted from the interface between the anodic oxide coating and the propeller body by about 10 μm toward the surface of the anodic oxide coating, and the measurement was taken so that the pad center coincided with this position.

Abrasion Resistance Characteristics

A sand-dropping abrasion test as defined under JIS H8501 was performed for a certain period of time, and acceptability was determined based on exterior appearance. "○" indicates that the propeller body (base) is not exposed; and "×" indicates that the propeller body is exposed.

TABLE 1

| Sample | material | chemical polishing treatment | anodic oxidation treatment time (min.) | Coating thickness: measurement value (μm) | Coating thickness: min./max. ratio (%) | coating hardness: near-material level (HV) | coating hardness: near-surface level (HV) | anti-abrasion characteristics |
|---|---|---|---|---|---|---|---|---|
| Ex. 1 | Al—4Mg | YES | 30 | 23-44 | 52 | 432 | 382 | ○ |
| Ex. 2 | Al—4Mg | YES | 45 | 38-60 | 63 | 430 | 370 | ○ |
| Ex. 3 | Al—4Mg | YES | 60 | 55-88 | 63 | 420 | 350 | ○ |
| Ex. 4 | Al—5Si | YES | 60 | 20-45 | 44 | 370 | 330 | ○ |
| Com. Ex. 1 | Al—5Si | NO | 60 | 18-53 | 34 | 375 | 330 | X |
| Com. Ex. 2 | Al—5Si | YES | 75 | 28-75 | 37 | 378 | 305 | X |
| Com. Ex. 3 | Al—4Mg | NO | 75 | 38-103 | 37 | 405 | 315 | X |

As can be seen from the results of Examples 1 to 3, by performing a chemical polishing treatment before anodic oxidation, variations in the film thickness of the anodic oxide coating are reduced so that the thickness at the thinnest portion corresponds to about 50% or more of the thickness at the thickest portion. Moreover, since the variations the film thickness are small, even at the thinnest portion, a thickness of about 20 μm or more is obtained from approximately 30 minutes of anodic oxidation treatment. A hardness of about 330 HV or more is also attained at the near-surface level. From these characteristics, it can be seen that the propellers of Examples 1 to 3 have sufficient abrasion resistance. Among Examples 1 to 3, which were subjected to different durations of anodic oxidation treatment, it can be seen that the hardness at the near-surface level decreases as the anodic oxidation treatment time increases. The presumable reason is a deterioration of the near-surface level region which occurs as the generated anodic oxide film is immersed in the anodic oxidation treatment liquid for a long period of time. However, since the anodic oxide coating has a highly uniform film thickness, it is possible to increase the thickness of the thinnest portion while maintaining hardness in the near-surface level at about 330 HV or more. In Example 3, the hardness at the near-surface level is about 350 HV, whereas the thickness of the thinnest portion is about 55 μm. This indicates that the propeller of Example 3, which includes an entirely thick anodic oxide coating with a high surface hardness, has a very excellent abrasion resistance.

Moreover, as indicated by the result of Example 4, even in the case where silicon is contained in the aluminum alloy, so long as the percentage content thereof is about 5%, with a chemical polishing treatment which is performed before anodic oxidation it is possible to form an anodic oxide coating that has a thickness of about 20 μm or more in its thinnest portion and has a hardness or about 330 HV or more at the near-surface level.

A comparison between the results of Example 3 and Example 4 indicates that, when less silicon is contained in the aluminum alloy, an anodic oxide coating with a greater film thickness uniformity can be formed, which means that a shorter time is needed for obtaining a thickness of a predetermined value or above in the thinnest portion of the anodic oxide coating. The shorter anodic oxidation treatment time allows for less deterioration in hardness at the near-surface level, whereby a propeller for watercraft having even more excellent anti-abrasion characteristics is provided. On the other hand, the addition of silicon would make it possible to obtain a propeller for watercraft having practically sufficient anti-abrasion characteristics while enhancing melt flowability and improving castability. It can be seen that, in Comparative Examples 1 to 3, the thickness of the thinnest portion is only about 40% or less of the thickness of the thickest portion, indicative of considerable variations in the film thickness of the anodic oxide coating. Thus, the film thickness of the thinnest portion is insufficient even if a sufficient hardness (about 330 HV or more) is achieved at the near-surface level, as can be seen from the result of Comparative Example 1. Moreover, the results of Comparative Examples 2 and 3 indicate that performing a long anodic oxidation treatment in order to increase the film thickness of the thinnest portion to about 20 μm or more will lead to an insufficient hardness at the near-surface level.

From these results, it can be seen that an excellent abrasion resistance is provided by ensuring that the anodic oxide coating has a thickness of about 20 μm or more in the thinnest portion and a hardness of about 330 HV or more at the near-surface level.

Figure 10A:
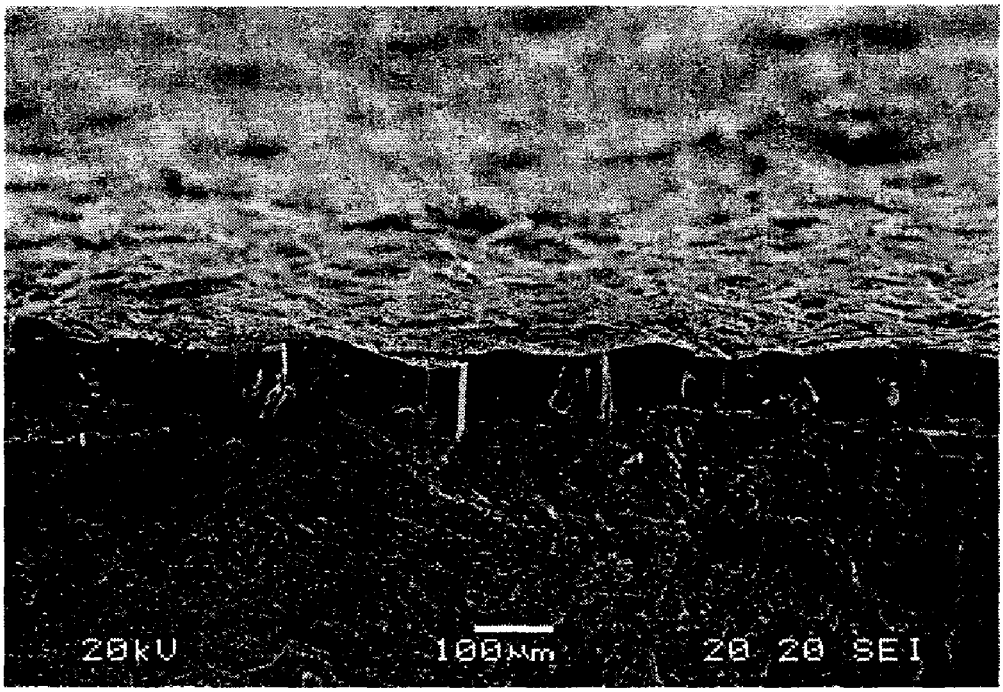
FIGS. 10A and 10B are cross-sectional SEM photographs of a propeller according to an example of preferred embodiments of the present invention.
Figure 10B:
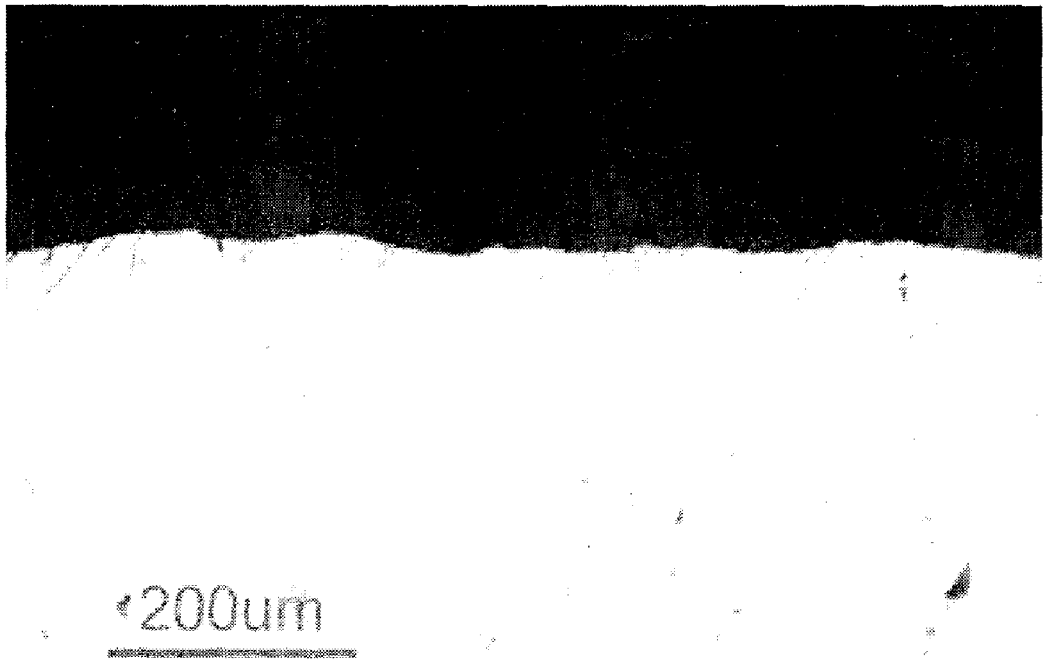
Figure 11A:
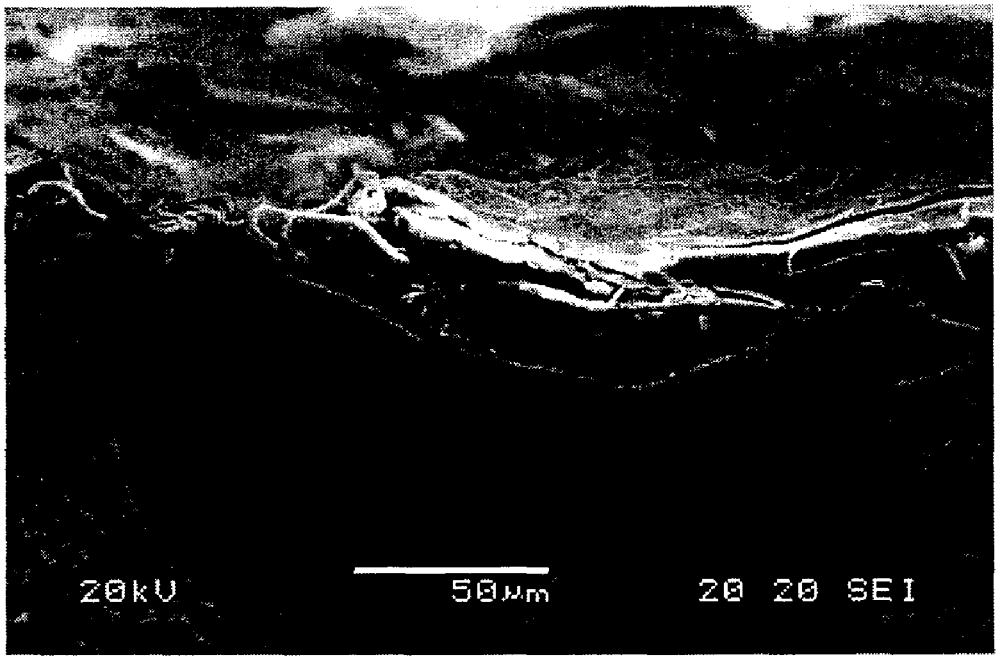
FIGS. 11A and 11B are cross-sectional SEM photographs of a propeller as a comparative example.
Figure 11B:
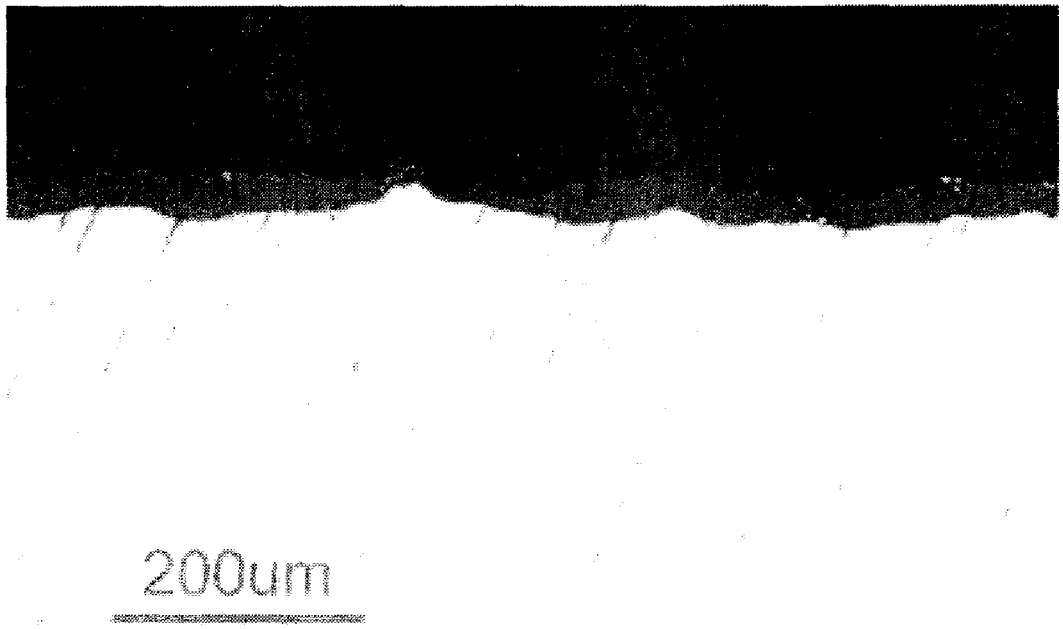

FIGS. 10A and 10B are cross-sectional SEM photographs of the propeller of Example 3. FIGS. 11A and 11B are cross-sectional SEM photographs of the propeller of Comparative Example 1. In these photographs, the lowest layer reveals a cross section of the propeller body, whereas the middle layer reveals a cross section of the anodic oxide film.

As can be seen from these figures, the anodic oxide coating of the propeller of Example 3 has a uniform film thickness, whereas the anodic oxide coating of the propeller of Comparative Example 1 has a notably non-uniform film thickness.

The propeller for watercraft and outboard motor according to various preferred embodiments of the present invention is suitably used for various kinds of boats, and is particularly suitably used for small-sized boats intended for various purposes, e.g., fishery, business operations, or leisure activities.

While the present invention has been described with respect to preferred embodiments thereof, it will be apparent to those skilled in the art that the disclosed invention may be modified in numerous ways and may assume many embodiments other than those specifically described above. Accordingly, it is intended by the appended claims to cover all modifications of the invention that fall within the true spirit and scope of the invention.

This application is based on Japanese Patent Applications No. 2006-352833 filed on Dec. 27, 2006 and No. 2007-319245 filed on Dec. 11, 2007, the entire contents of which are hereby incorporated by reference.

What is claimed is:

1. A propeller for watercraft, comprising:

a propeller body having a blade and a hub portion, the propeller body being made of a cast aluminum alloy; and an anodic oxide coating of the aluminum alloy arranged so as to cover a surface of the propeller body; wherein the anodic oxide coating has a thickness of about 20 μm or more in a thinnest portion and a hardness of about 330 HV or more at a near-surface level in a thickest portion.

2. The propeller for watercraft of claim 1, wherein the film thickness of the anodic oxide coating in the thinnest portion corresponds to about 50% or more of the film thickness in the thickest portion.

3. The propeller for watercraft of claim 2, wherein the anodic oxide coating has a thickness of about 100 μm or less in the thickest portion.

4. The propeller for watercraft of claim 1, wherein the hardness of the thickest portion of the anodic oxide coating at the near-surface level is no less than about 330 HV and no more than about 450 HV.

5. The propeller for watercraft of claim 1, wherein the aluminum alloy is an Al—Mg alloy containing no less than about 0.3 wt % and no more than about 2.0 wt % of silicon.

6. The propeller for watercraft of claim 5, wherein the propeller body is made of die-cast aluminum alloy.

7. The propeller for watercraft of claim 5, wherein the anodic oxide coating has a smaller silicon content than that of the propeller body.

8. An outboard motor comprising the propeller for watercraft of claim 1.

9. A boat comprising the propeller for watercraft of claim 1.

* * * * *